US006167649B1

(12) United States Patent
Palmeri

(10) Patent No.: US 6,167,649 B1
(45) Date of Patent: Jan. 2, 2001

(54) INFORMATION DISPLAY SYSTEM FOR THE SIDES OF BUILDINGS AND VEHICLES

(76) Inventor: Richard P. Palmeri, 1211 S. Ramona Ave., Indialantic, FL (US) 32903

( * ) Notice: Under 35 U.S.C. 154(b), the term of this patent shall be extended for 0 days.

(21) Appl. No.: 09/058,900

(22) Filed: Apr. 8, 1998

(51) Int. Cl.[7] ..... G09F 17/00
(52) U.S. Cl. ..... 40/603; 38/102.91
(58) Field of Search ..... 40/603; 38/102.4, 38/102.91, 102.1, 102

(56) References Cited

U.S. PATENT DOCUMENTS

| | | | | |
|---|---|---|---|---|
| 3,359,663 | * | 12/1967 | Black | 38/102.91 |
| 3,482,343 | * | 12/1969 | Hamu . | |
| 4,041,861 | * | 8/1977 | Alter | 38/102.91 X |
| 5,349,772 | * | 9/1994 | Pardue | 40/603 X |
| 5,373,655 | * | 12/1994 | Suzuki | 40/603 |
| 5,507,109 | * | 4/1996 | Rinzler | 40/603 |
| 5,845,423 | * | 12/1998 | Hicks | 40/603 |
| 5,937,751 | * | 8/1999 | Newman, Jr. | 38/102.4 X |

* cited by examiner

*Primary Examiner*—Joanne Silbermann
(74) *Attorney, Agent, or Firm*—Angus C. Fox, III

(57) ABSTRACT

An information display system, mountable on planar surfaces such as the walls of buildings or the sides of semi-trailers, includes a frame and a polygonal flexible sheet perimetricly anchored to the frame. The system includes at least one anchoring bracket rigidly attached to the planar surface at each of the sheet's apices or corner locations. Other anchoring brackets may be rigidly attached to the planar surface at various locations along the sign's edges. The sign may be a sheet of flexible polymeric material which may be optionally fiber-reinforced. Alternatively, the sign may be cloth made from tightly woven natural or synthetic fibers. An advertising message or other graphic information is printed on the sign, which is hemmed along its perimetric edges to create a sleeve surrounding the sheet. At least one retaining device is inserted through the perimetric sleeve, and the sheet is secured by tensioning means attached to the anchoring brackets which act on the retaining device(s). For a first embodiment of the invention, the retaining devices includes multiple hollow tension beams, each of which has longitudinal slit through which a portion of the hemmed edge of the flexible sheet is inserted. A trapping stick, rod or tube, inserted through a portion of the sleeve inserted within the tension beam effectively secures the hemmed edge to the tension beam. Each tension beam encloses a portion of the perimetric sleeve. Each end of tension beam is secured to an anchoring bracket with tensioning bolts. The tightening action stretches the flexible panel within the anchoring frame so as to provide a smooth surface on which the information is displayed.

17 Claims, 12 Drawing Sheets

INFORMATION DISPLAY SYSTEM FOR THE SIDES OF BUILDINGS AND VEHICLES

FIELD OF THE INVENTION

This invention relates to advertising and information display systems and, more particularly, to display systems having easily replaceable display media.

BACKGROUND OF THE INVENTION

The use of advertising sign boards is widespread throughout the world. Considered an eyesore and a distraction by many, control over the erection and location of sign boards has been asserted by statute in various states and by local ordinances in many municipalities. The anti-billboard statutes and ordinances commonly ban the presence of sign boards along the sides of highways. As a means of circumventing the ban, advertisers routinely place advertising on the sides of semi-trailers and then park the trailers on private lots adjacent the highways. Although the sides of a trailer function well as sign boards, trailers are relatively expensive, and most of their utility is lost when they relegated to duty as stationary objects.

There is considerable interest in using the sides of semi-trailers as advertising billboards. Tens of millions of semi-trailer-tractor rigs ply the world's highways on a daily basis. Trucks can be divided into two important groups: Those that are owned by transportation companies, and those that are owned by companies engaged in primarily in other pursuits. Tractor-trailer rigs belonging to the former group generally provide transportation services to a constantly-varying list of customers, and each rig typically displays nothing more than the name of the trucking company. Rigs belonging to the latter group are generally used exclusively in the service of the owning company and generally display permanent advertising that is painted or bonded to the trailer.

Although there is widespread recognition that tractor-trailer rigs owned by transportation companies have tremendous advertising potential, the costs involved with the application of advertising signs to the sides of trailers and their subsequent removal are a real hindrance. For example, painted signs are fine for permanent advertising. However, for temporary advertising, the labor and talent required to paint attractive signs on the side of a truck is costly. And those costs don't take into account the costs incurred by the trailer downtime during the painting operation. Removal of unwanted signs is also problematic. Not only does removal completely destroy the sign, but the Environmental Protection Agency and other similar state agencies are making it increasingly difficult to use paint removers containing methylene chloride. Hence, the old paint must be removed either with less-effective chemicals or by bead blasting. Thus, removal of the painted sign will also result in significant trailer downtime.

In cases where advertising is printed on a vinyl or other polymeric plastic sheet which is, in turn, adhesively applied to the sides of a truck, a high level of skill is required to correctly apply the panel without inadvertently incorporating ripples or bubbles into the surface. As with painted advertising, removal of adhesively-adhered polymeric plastic advertising sheets will result in their destruction, and removal is time-consuming and difficult.

Many of the problems associated with the application of advertising material to the sides of vehicles also apply to the application of advertising material to the sides of buildings. When driving through older cities and towns, it is not uncommon to see painted signs on the sides of buildings that date to the last century. Once again, although the signs have long since ceased to have any utility, their removal is difficult.

There is a need for an efficient advertising display system which can be used on the sides of buildings and the sides of vehicles, such as semi-trailers. The system must be relatively simple to install, relatively inexpensive, and permit the rapid changing of advertising material displayed without destruction of the removed material.

SUMMARY OF THE INVENTION

This invention provides an information display system which can be mounted on planar surfaces, such as the walls of buildings or the sides of semi-trailers. The system includes at least one anchoring bracket rigidly attached to the planar surface at each of a polygonal sign's apices, or corner locations. Other anchoring brackets may be rigidly attached to the planar surface at various locations along the sign's edges. An advertising message and/or graphic display is printed on a sheet of flexible polymeric material, which is hemmed along its edges to create a perimetric sleeve surrounding the sheet. The corners of the sheet are cut off so that the interior of the sleeve at each corner is accessible. The perimetric edge of the sign sheet is secured to a frame by the sleeve. The frame, in turn, is secured to the anchoring brackets via tensioning devices.

For a first embodiment of the invention, the frame includes multiple hollow tension beams, each of which has longitudinal slit through which a portion of the sleeve formed by the hemmed edge is inserted. A trapping stick, rod or tube, inserted through the sleeve after the sleeve has been inserted within the tension beam through the slit, effectively secures the hemmed edge of the sign sheet to the tension beam. The end of each tension beam, which encloses a portion of the perimetric sleeve, is tightened against an anchoring bracket with tensioning bolts. The tightening action stretches the flexible panel within the frame so as to provide a smooth surface on which the advertising message may be displayed.

For a second embodiment of the invention, the frame includes multiple tension struts, each of which is inserted in a portion of the perimetric sleeve. The third embodiment shares design elements of both the first and second embodiments. Unlike the first embodiment, the sleeve of the sign sheet is exposed rather than trapped within the tension beams. The tension struts are positioned end to end within the sleeve around the perimeter of the sign sheet. As with the tension beams of the first embodiment, the end of each tension strut is tightened against an anchoring bracket with tensioning bolts. The anchoring brackets of the second embodiment may be identical to those of the first embodiment.

For a third embodiment of the invention, the frame is a cable. Load distributing-tubes are inserted within the perimetric sleeve and the cable is inserted through the load-distributing tubes, forming a loop which surrounds the entire perimetric edge. The ends of the cable are joined with one of various types of available connectors which are crimped to each end of the cable. The connector also allows the length of the cable to be adjusted. The cable is then tightened at the corners of the rectangular frame, preferably with pulleys, and optionally along the edges of the sheet.

For any of the three embodiments of the invention, a gap seal may be employed to block airflow beneath the polymeric sheet, which might otherwise cause billowing, flapping, and eventual tearing of the polymeric sheet. An effective gap seal may also be formed by a secondary frame, which incorporates the anchoring brackets therein. For advertising display mounting on buildings, wind direction may vary from time to time. For such an application, a secondary frame has an advantage of preventing airflow beneath the sheet from all directions.

DETAILED DESCRIPTION OF THE INVENTION

Figure 1:
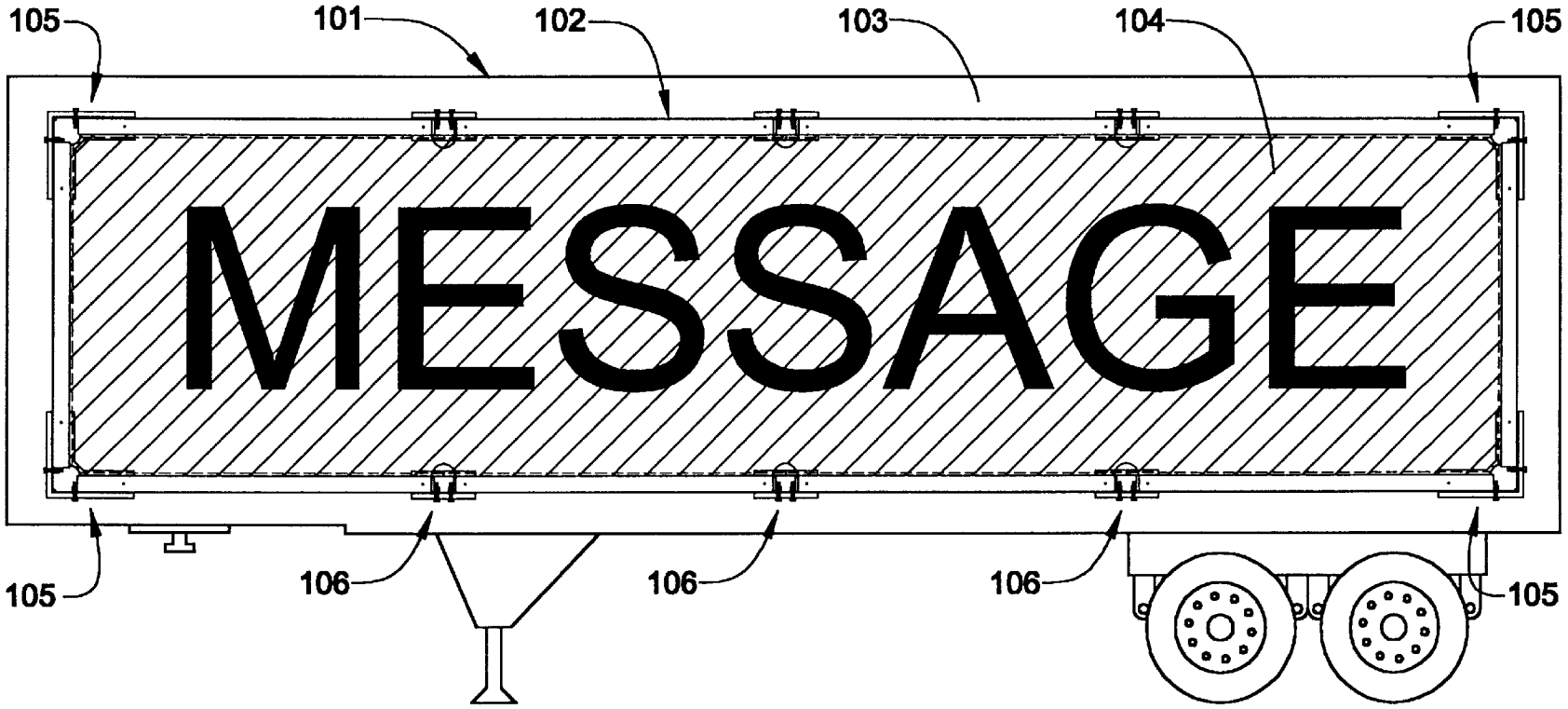
FIG. 1 is a side elevational view of a first embodiment of the new advertising display system installed on the side of a semi-trailer.

The new information display system is readily mounted on a variety of planar surfaces, such as the walls of buildings or the sides of semi-trailers. Referring now to FIG. 1, a semi-trailer 101 having a first embodiment of the new information display system 102 mounted on a sidewall 103 thereof is depicted. The display system is depicted as having a flexible sign sheet 104 having the word "MESSAGE" printed thereon. The visible limits of the sign sheet 104, which varies slightly depending on the embodiment, are represented by the diagonal hatching in FIGS. 1, 7 and 12. The sign sheet 104 may be made from polymeric plastic material, fiber-reinforced polymeric material, or cloth such as canvas. Polymeric plastic is the preferred material, as it is readily printed with bright, fade-resistant inks. The sign sheet 104 is attached to a frame by a perimetric sleeve (not readily visible in this view). The frame is attached to various anchoring brackets around the perimeter of the sheet via tensioning devices. The anchoring brackets are, in turn, attached to the side wall of the semi-trailer. Corner anchoring brackets 105 are used to anchor the frame at the corners of the sign sheet 104, while partial-span anchoring brackets 106 are used to anchor the frame at locations between the corners.

The shapes and forms taken by the frame and the various types of anchoring brackets, the tensioning devices employed thereon, and various methods employed to secure the sign sheet to the anchoring brackets vary from embodiment to embodiment, and will be hereinafter discussed in detail. However, for the three embodiments described herein, the sign sheet 103 remains virtually unchanged.

Figures 2, 3:
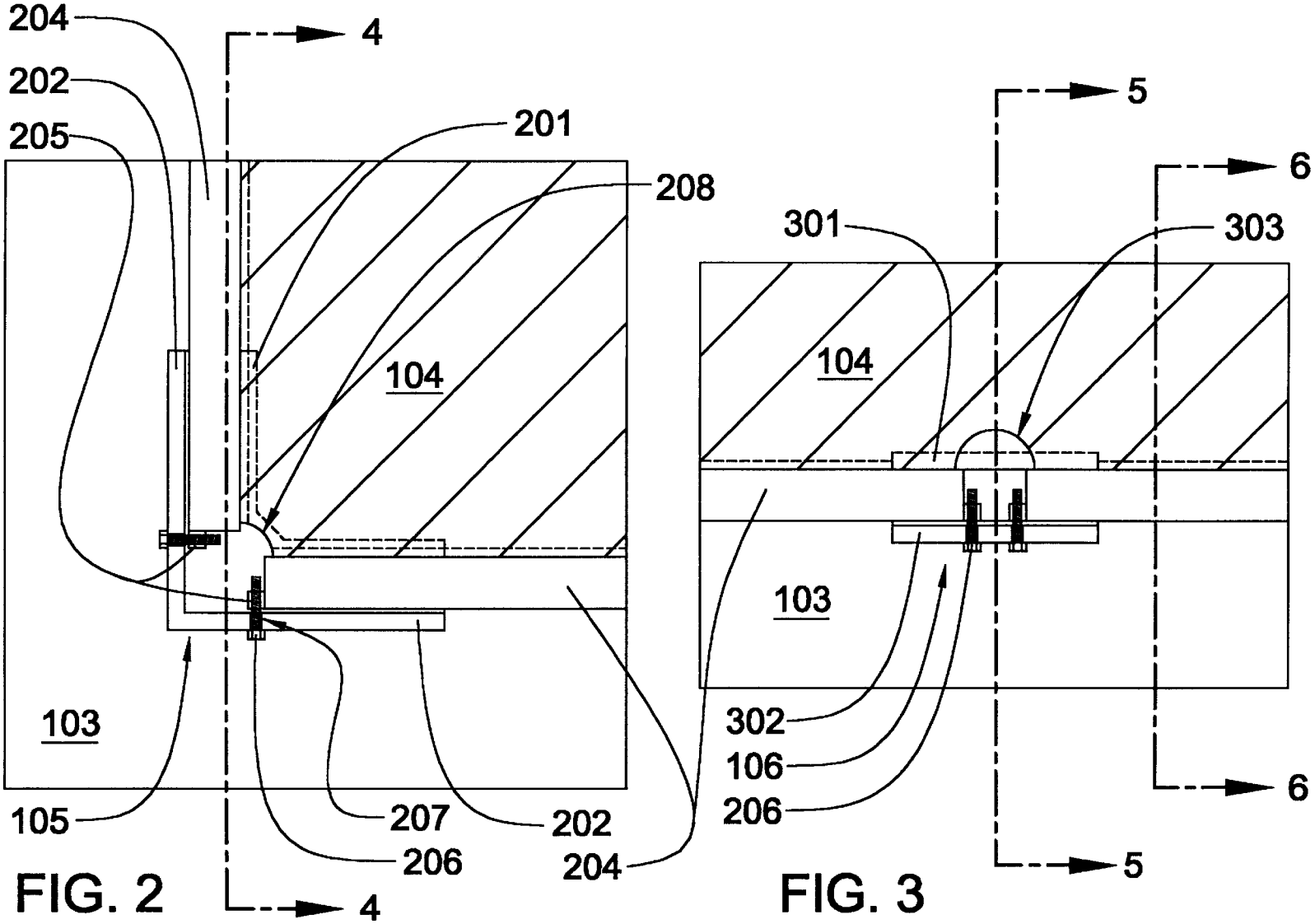
FIG. 2 is a close-up side-elevational view of a corner anchoring bracket of the first embodiment system of FIG. 1.
FIG. 3 is a close-up side-elevational view of a partial-span anchoring bracket of the first embodiment system of FIG. 1.

Referring now to FIG. 2, a close-up view of a corner section of the first embodiment of the information display system of FIG. 1 includes a corner anchoring bracket 105 rigidly attached to the outer planar surface of the trailer sidewall 103 at each corner location of the rectangular advertising sign sheet 104. Each corner bracket 105 includes a laminar portion 201 which is rigidly secured to the trailer sidewall or building wall, preferably with counter-sunk-head fasteners such as screws or rivets. Each corner bracket 105 has a pair of intersecting tension flanges 202, each of which is integral with and perpendicular to the laminar portion 201. The sign sheet 104 has a radiused cut-out 208 at each corner bracket 105 which permits access to the perimetric sleeve helps prevent tearing of the sign sheet 104.

Referring now to FIG. 3, partial-span anchoring brackets 106 are located along the perimetric edge of the rectangular advertising sign sheet 104 between corner anchoring brackets 105. Like the corner-anchoring brackets 105, the partial-span anchoring brackets 106 are rigidly mounted to the outer planar surface of the trailer sidewall 103. Each partial-span anchoring bracket 106 includes a laminar portion 301 and a single tension mounting flange 302 which is integral with and perpendicular to the laminar portion 301. The sign sheet 104 has a radiused cut-out 303 at each partial-span brackets 106 which permits access to the perimetric sleeve and helps prevent tearing of the sign sheet 104.

Referring now to both FIGS. 2 and 3, a tension beam 204 spans the distance between adjacent pairs of anchoring brackets. Each end of a tension beam 204 has a securing post 205 rigidly affixed thereto by, for example, welding or riveting. Each securing post 205 has a female threaded end which engages a tensioning bolt 206 which passes through a hole 207 in a tension flange 202 or 302. A portion of the perimetric sleeve of the advertising sign sheet 104 is secured to each tension beam 204 in a manner that will be subsequently described with reference to FIGS. 4, 5 and 6. Thus, by tightening each of the bolts 206 which engages a securing post 205, the sign sheet 104 can be stretched between the anchoring brackets 105 and 106, much as a painter's canvas is stretched within its frame.

Figure 4:
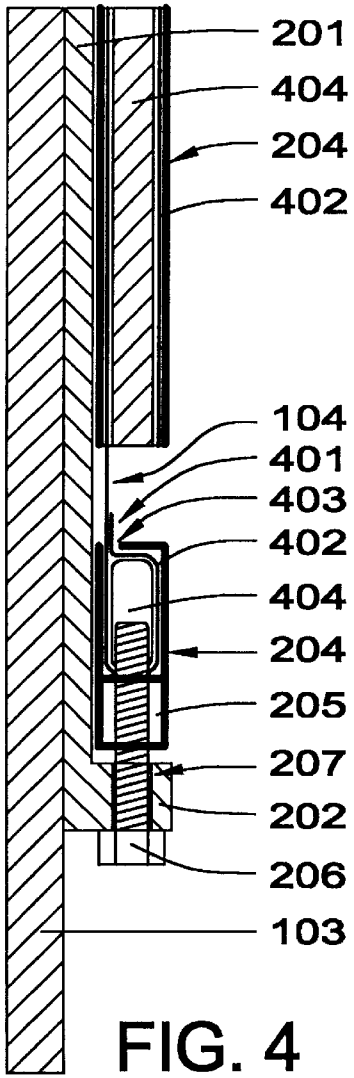
FIG. 4 is a cross-sectional view through line 4—4 of FIG. 2.

Referring now to FIG. 4, the manner in which a portion of the perimetric sleeve is retained within each tension beam 204 is now readily apparent. The edge of the sign sheet 104 is folded back on the sheet and bonded to the sheet along a hem line 401, thereby forming a sleeve 402. The sleeve 402 is inserted through a longitunidal slot 403, which runs the full length of tension beam 204. A trapping stick, rod or tube 404, which is inserted through the sleeve 402, traps a portion of the sleeve 402 of sign sheet 104 within the tension beam 204. In this view, it will be noted that the laminar portion 201 of corner anchoring bracket 105 is integral with the tension flange thereof 202. Also visible in are the securing post 205, the hole 207 in tensioning flange 202, and the tensioning bolt 206.

Figure 5:
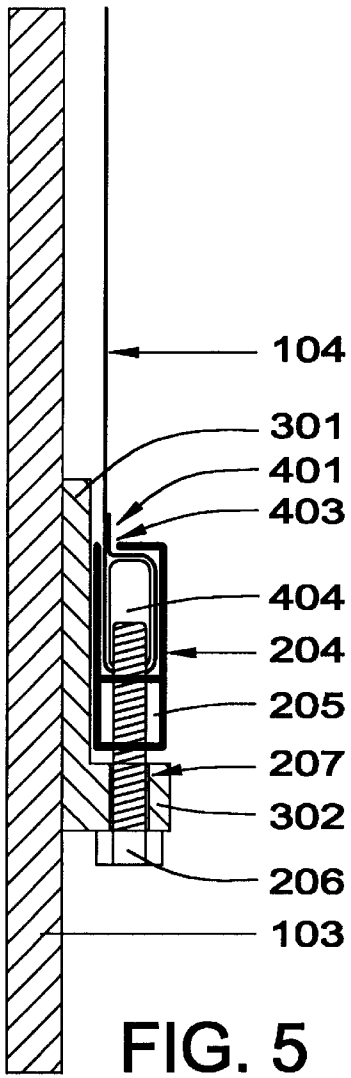
FIG. 5 is a cross-sectional view through line 5—5 of FIG. 3.

Referring now to FIG. 5, the cross-sectional view through the partial-span anchoring bracket 106 and the sign sheet 104 is similar to the view through the corner anchoring bracket 105. The difference in the views is that in FIG. 5, there is no longitudinal view through the tension beam 204 and the laminar portion 301 of the bracket is different.

Figure 6:
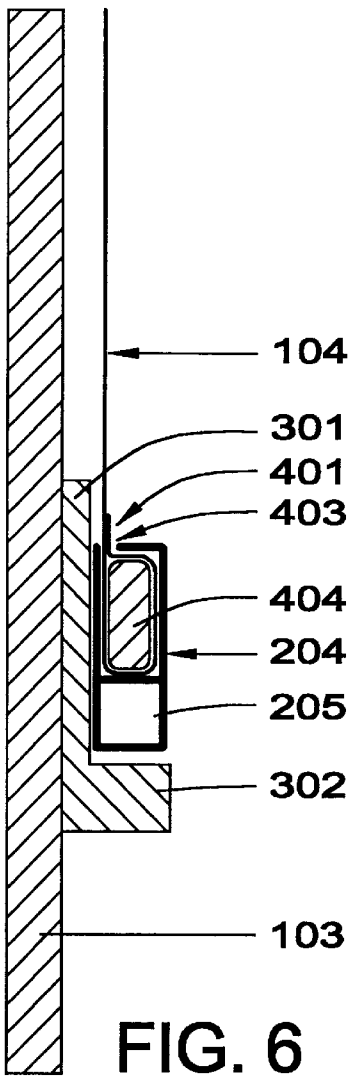
FIG. 6 is a cross-sectional view through line 6—6 of FIG. 3.

Referring now to FIG. 6, the view through the tension beam is similar to the view of FIG. 5, except that no partial-span anchoring bracket 106 is visible.

Figure 7:
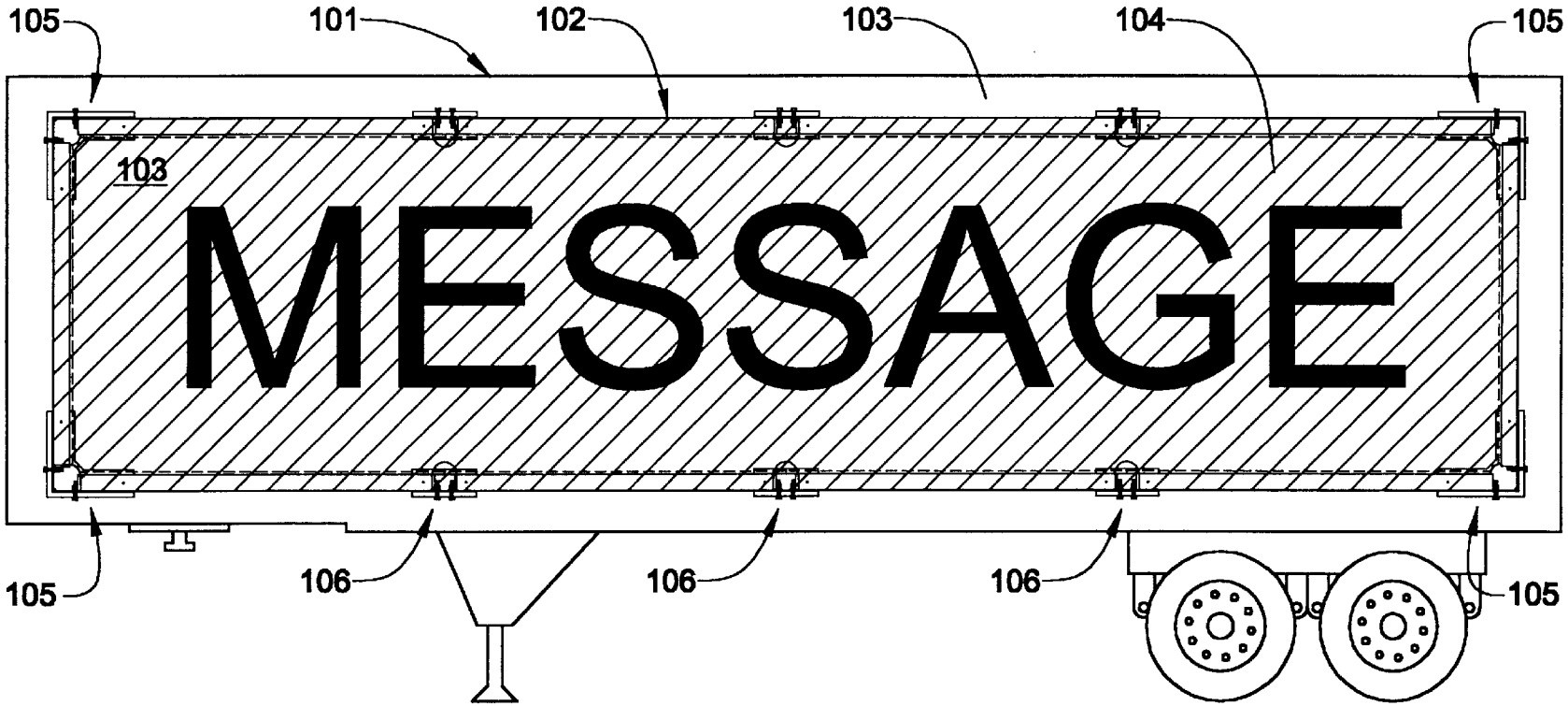
FIG. 7 is a side-elevational view of a second embodiment of the new advertising display system installed on the side of a semi-trailer.

Referring now to FIG. 7, a second embodiment of the information display system is similar to the first embodiment. The corner anchoring brackets 105 and partial-span anchoring brackets 106 are identical to those of the first embodiment depicted in FIGS. 1–6. The differences lie in the design of the tension beams. In order to distinguish them from those of the first embodiment, those of the second embodiment shall be referred to hereinafter as tension struts. The perimetric sleeve of the sign sheet 104 is exposed, and no trapping rod, stick or tube 404 is employed. Instead, each tension strut is inserted through a portion of the perimetric sleeve. This will be more apparent in FIGS. 8–11.

Figure 9:
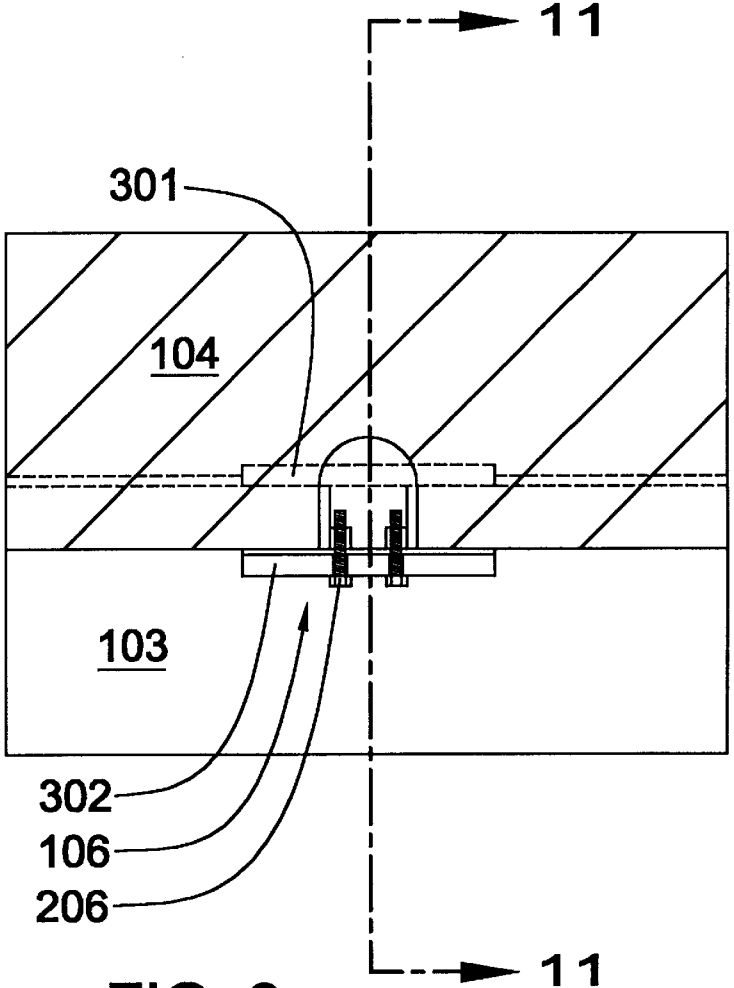
FIG. 9 is close-up side-elevational view of a partial-span anchoring bracket of the second embodiment system of FIG. 7.
Figure 8:
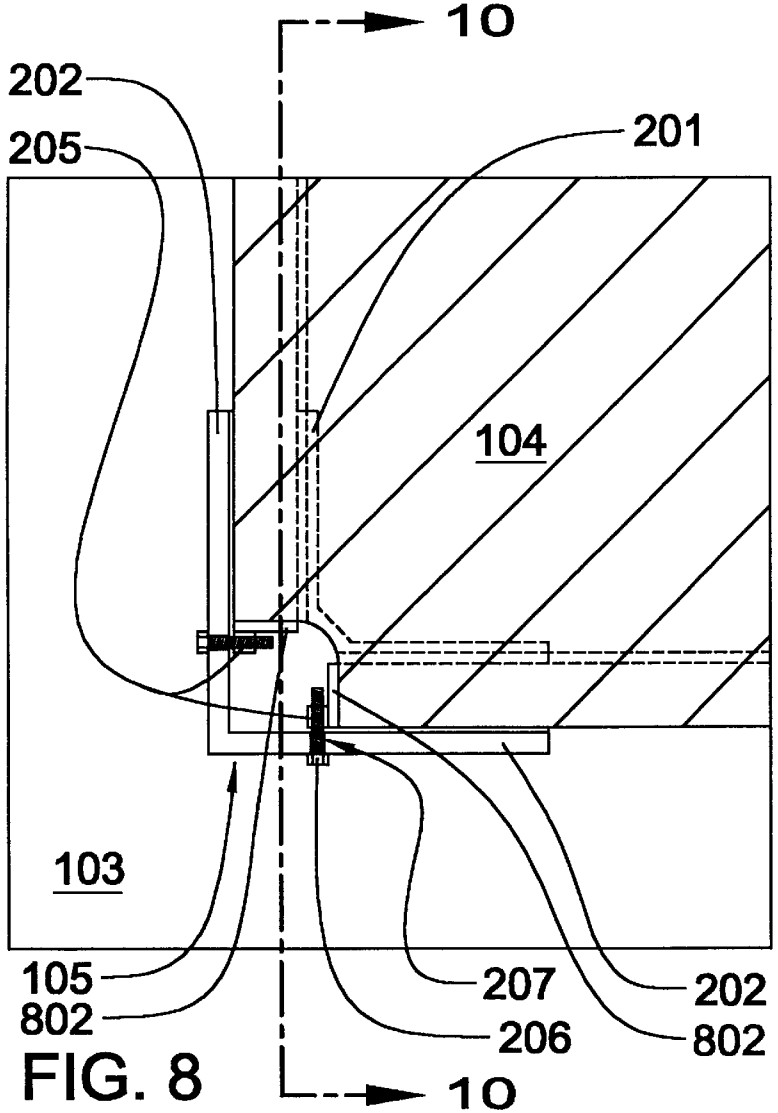
FIG. 8 is a close-up side-elevational view of a corner anchoring bracket of the second embodiment system of FIG. 7.

Referring now to FIGS. 8 and 9, the corner anchoring bracket 105 and the partial-span anchoring bracket 106 are identical to those of the first embodiment. However or this embodiment, the sleeve 801 of sign sheet 104 is exposed rather than being trapped within the tension beam of FIG. 2. Multiple tension struts 802 are inserted within the perimetric sleeve 801 so that they are positioned end to end around the perimeter of the sign sheet 104. As with the tension beams 204 of FIG. 2, each of the tension struts 802 has a securing post, or end member, 205 rigidly affixed thereto by, for example, welding or riveting. Each securing post 205 has a female threaded end which engages a tensioning bolt 206 which passes through a hole 207 in a tension flange 202. As the tensioning bolts 206 are tightened, the sign sheet is stretched within the frame formed by the tension struts 802.

Figure 11:
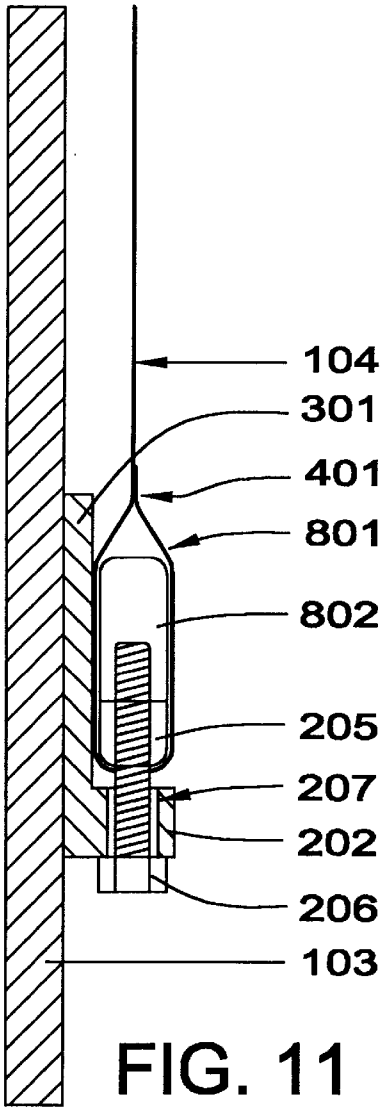
FIG. 11 is a cross-sectional view through line 11—11 of FIG. 9.
Figure 10:
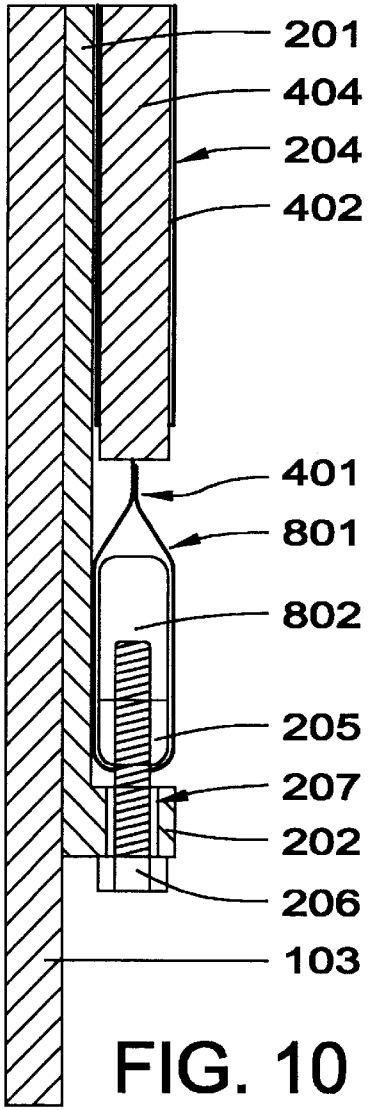
FIG. 10 is a cross-sectional view through line 10—10 if FIG. 8.

Referring now to FIGS. 10 and 11, the corner anchoring bracket 105 and the partial-span anchoring bracket are visible, as are the tension struts 802, the tensioning bolts 206, the threaded securing posts 205 and sign sheet 104. Also readily apparent is the manner in which the perimetric sleeve wraps around the tension struts 802.

Figure 12:
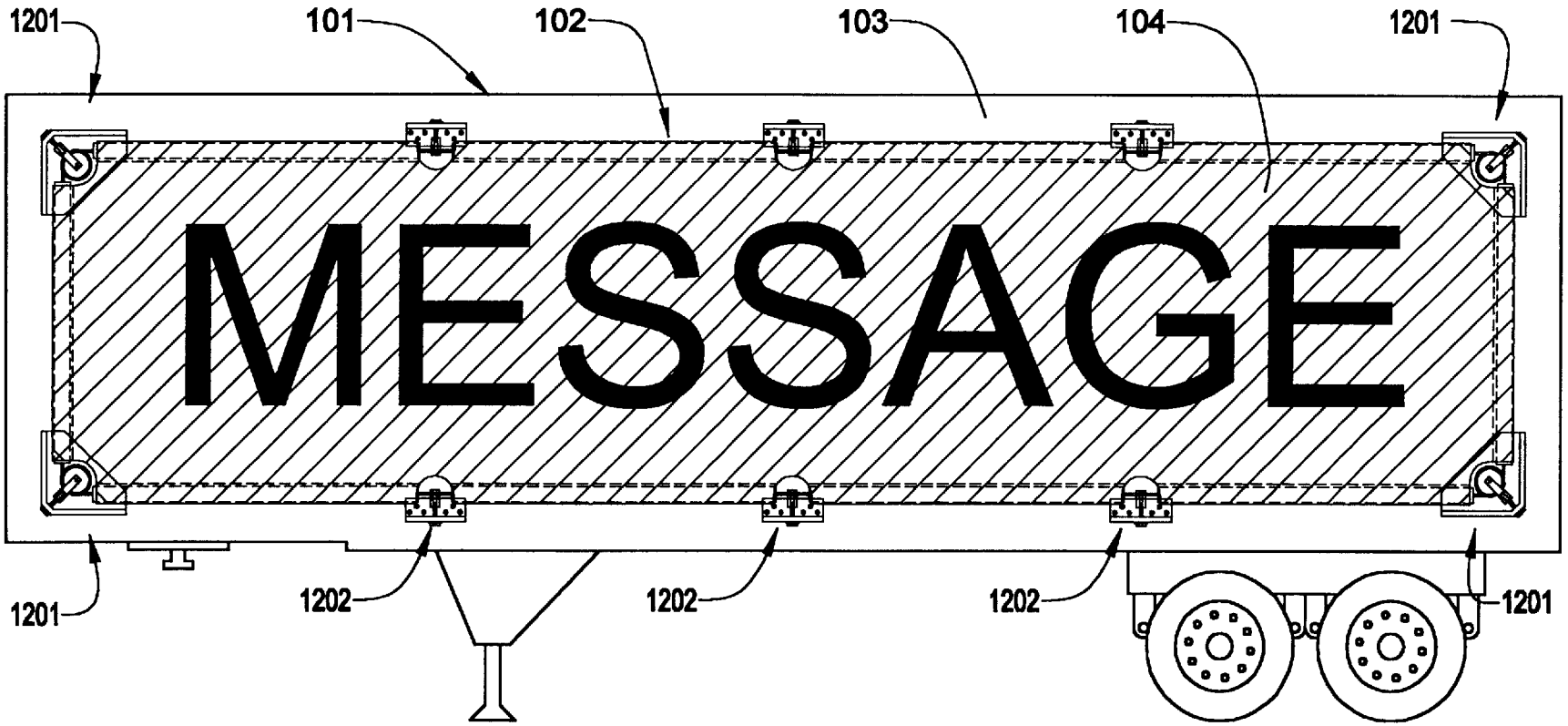
FIG. 12 is a side-elevational view of a third embodiment of the new advertising display system installed on the side of a semi-trailer.

Referring now to FIG. 12, a third embodiment of the new information display system utilizes an adjustable-length, looped cable as a frame. The cable is inserted through load-distributing tubes inserted within the perimetric sleeve and is supported by an adjustable pulley mounted on a corner anchoring bracket 1201 at each of the four corners of the display system. For a preferred implementation of this third embodiment, pulley-less partial-span anchoring brackets 1202 are employed. The various features of this embodiment are more clearly depicted in FIGS. 13–17.

Figure 13:
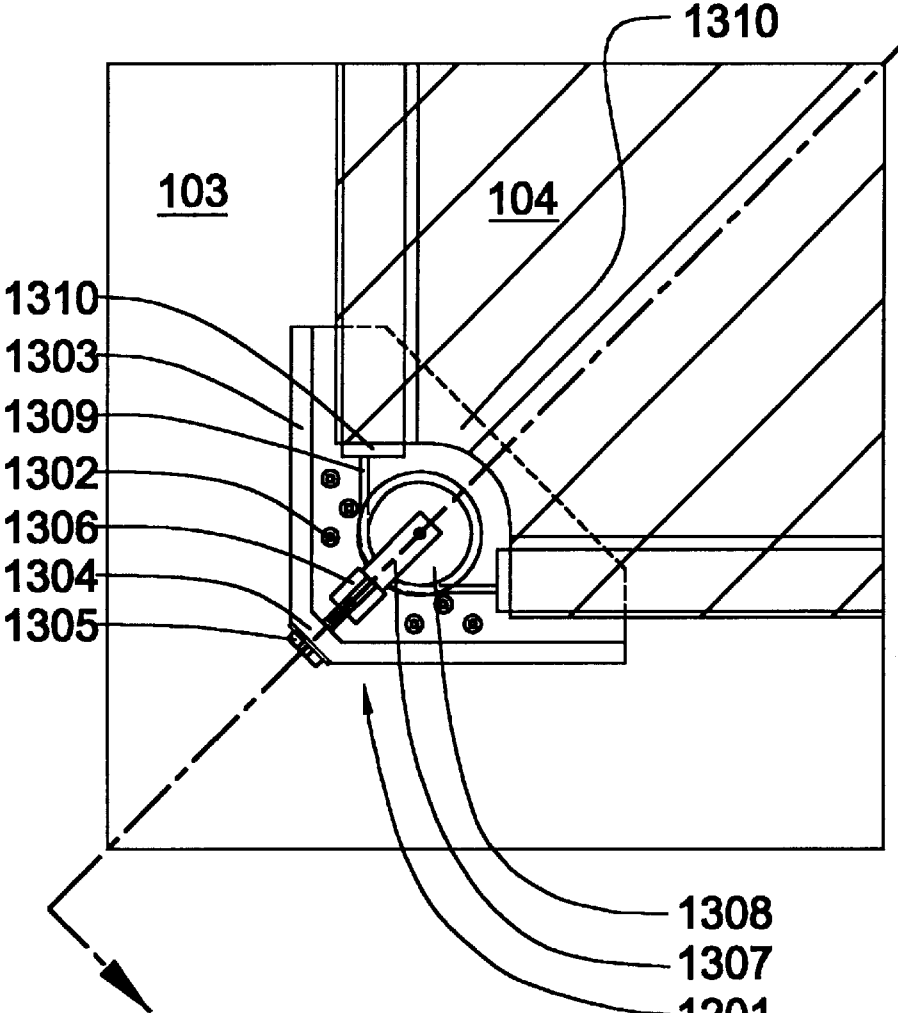
FIG. 13 is a close-up side-elevational view of a corner anchoring bracket of the third embodiment system of FIG. 12.

Referring now to FIG. 13, a corner anchoring bracket 1201 has a laminar portion 1301 that is secured to the planar surface 103 of the semi-trailer with rivets 1302 or threaded fasteners such as screws and bolts (not shown). The laminar portion 1301 is continuous with a pair of perpendicular of reinforcing flanges 1303 which are perpendicular to one another and interconnected by an angled tension flange 1304. Tension flange 1304 has a hole through which is fitted a tensioning bolt 1305 which engages a treaded collar 1306 which is attached to a U-shaped pulley cage 1307 which attached to a pulley 1308 at the latter's axis. By rotating bolt 1305, the pulley may be linearly moved. The heretoforementioned cable 1309 is looped around the pulley 1308 attached to each corner anchoring bracket. Load-distributing tubes 1310 are inserted with the perimetric sleeve 1311 and the cable 1309 is inserted through the load-distributing tubes 1310. The load-distributing tubes 1310 prevent the cable from tearing the sign sheet 104 as the pulleys are adjusted to tighten the looped cable 1309 and form a more or less rectangular frame which supports the sign sheet 104.

Figure 14:
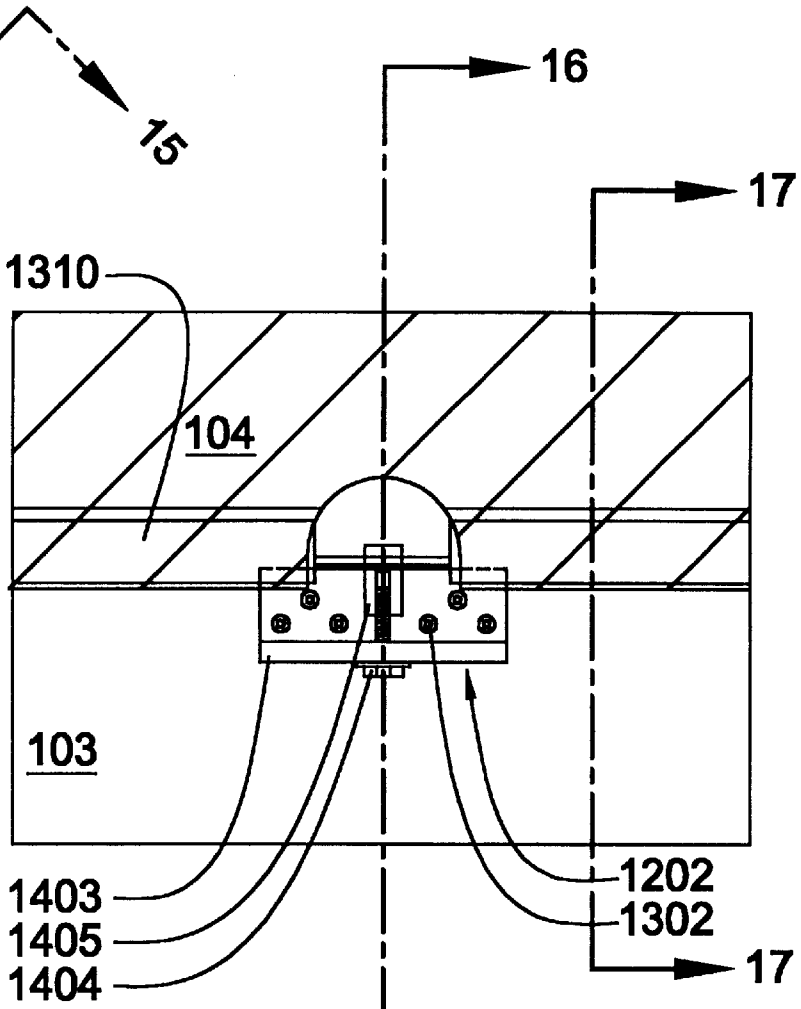
FIG. 14 is close-up side-elevational view of a partial-span anchoring bracket of the third embodiment system of FIG. 12.

Referring now to FIG. 14, optional partial-span anchoring brackets 1401 may be installed. Each partial-span anchoring bracket, which is formed from a laminar portion 1402 and a tension flange 1403, incorporates a tensioning device consisting of a tensioning bolt 1404 and an engaging threaded clamp 1405 which fits over the cable 1309. The partial-span anchoring brackets 1401 not only reduce the tension on cable 1309 required to maintain the sign sheet 104 taut within the rectangular frame formed by cable 1309, but also damp vibrations of the cable 1309 that might be caused by wind or buffeting while the semi-trailer is in motion. Because tension on the cable 1309 via the partial-span anchoring brackets 1401 is applied after the pulleys 1308 are adjusted to form the cable frame, there is no need for a pulley on the partial-span anchoring brackets 1401.

Figure 15:
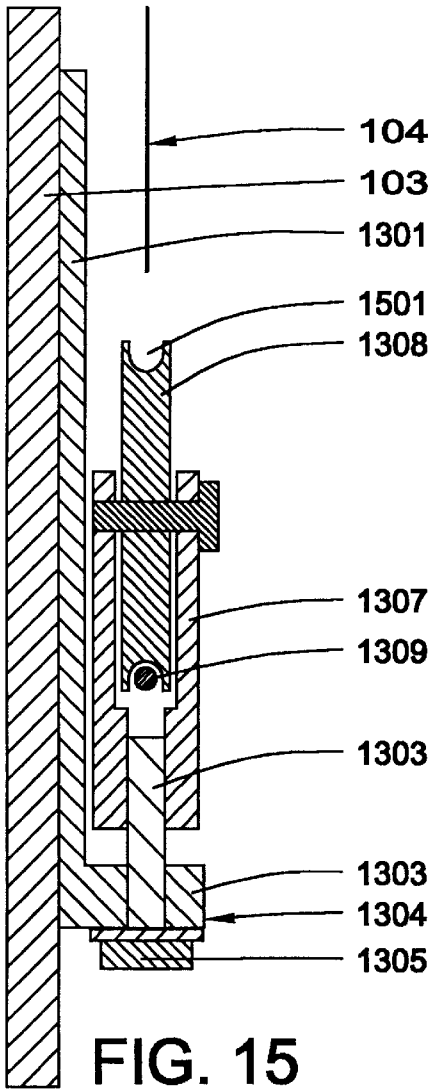
FIG. 15 is a cross-sectional view through line 15—15 of FIG. 13.

Referring now to FIG. 15, the cable 1309 is seen passing through the groove 1501 of pulley 1308. In this cross-sectional view of the corner anchoring bracket of this third embodiment of the invention, the sign sheet 104, the laminar portion 1301, and tension flange 1304, the tension bolt 1305, the threaded collar 1306 and the U-shaped bracket 1308 are clearly seen.

Figure 16:
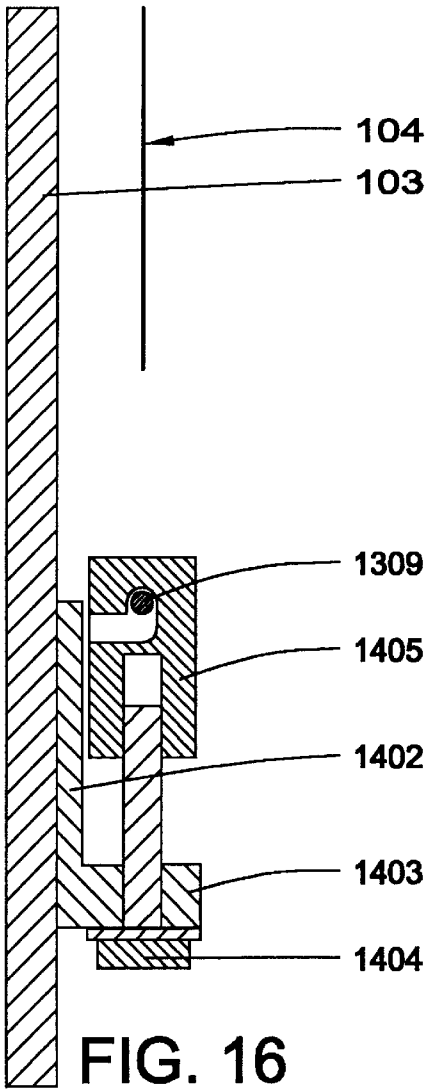
FIG. 16 is a cross-sectional view through line 16—16 of FIG. 14.

Referring now to FIG. 16, the laminar portion 1402, the tension flange 1403, the tensioning bolt 1404, the threaded clamp 1405 which engages the cable 1309, and the sign sheet 104 are all clearly visible in this view.

Figure 17:
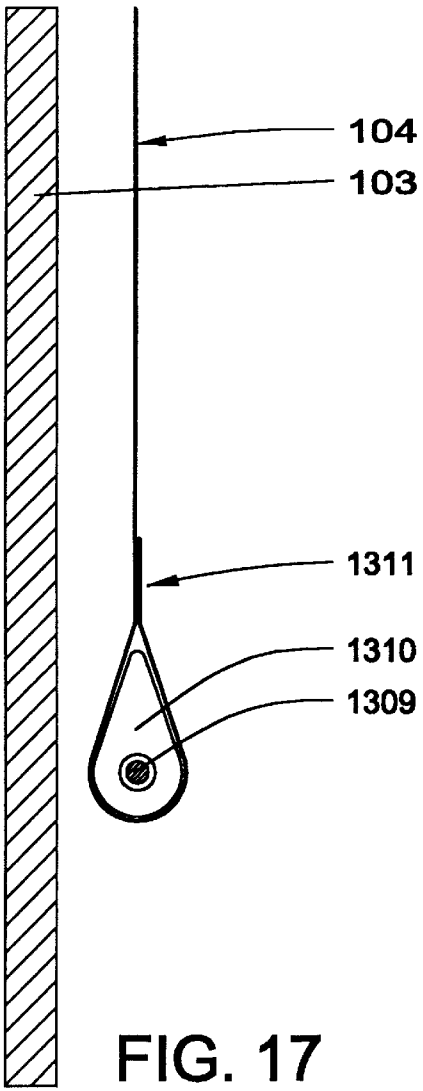
FIG. 17 is a cross-sectional view through line 17—17 of FIG. 14.

Referring now to FIG. 17, the sign sheet 104, the perimetric sleeve 1311 around the perimeter sign sheet 104, the load distributing tube 1310, and the cable 1309 are shown suspended above the planar sidewall 103 of the semi-trailer.

Figure 18:
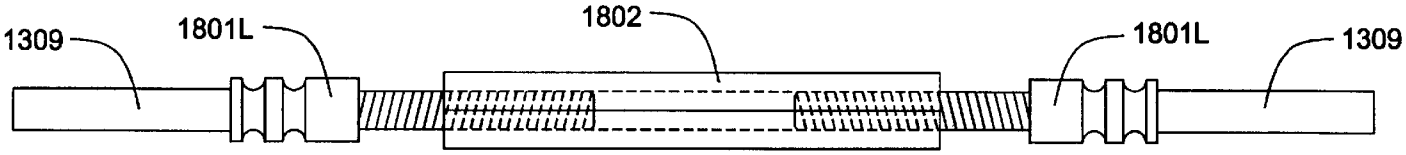
FIG. 18 is a side-elevational view of an adjustable cable end connector.

Referring now to FIG. 18, each end of the looped cable 1309 has a threaded male connector 1801L and 1801R crimped thereto. Connector 1801R has a right-hand thread, while connector 1801L has a left-hand thread. A female threaded coupler 1802 has both right-hand and left-hand threaded portions which simultaneously engage connectors 1801L and 1801R. As coupler 1802 is rotated about its central axis, the length of looped cable 1309 varies. In order for the cable frame of the third embodiment of the invention to properly fit the dimensions of sign sheet 104, it is essential that the length of cable 1309 be adjusted so that the sign sheet need to be overly stretched.

Figure 19:
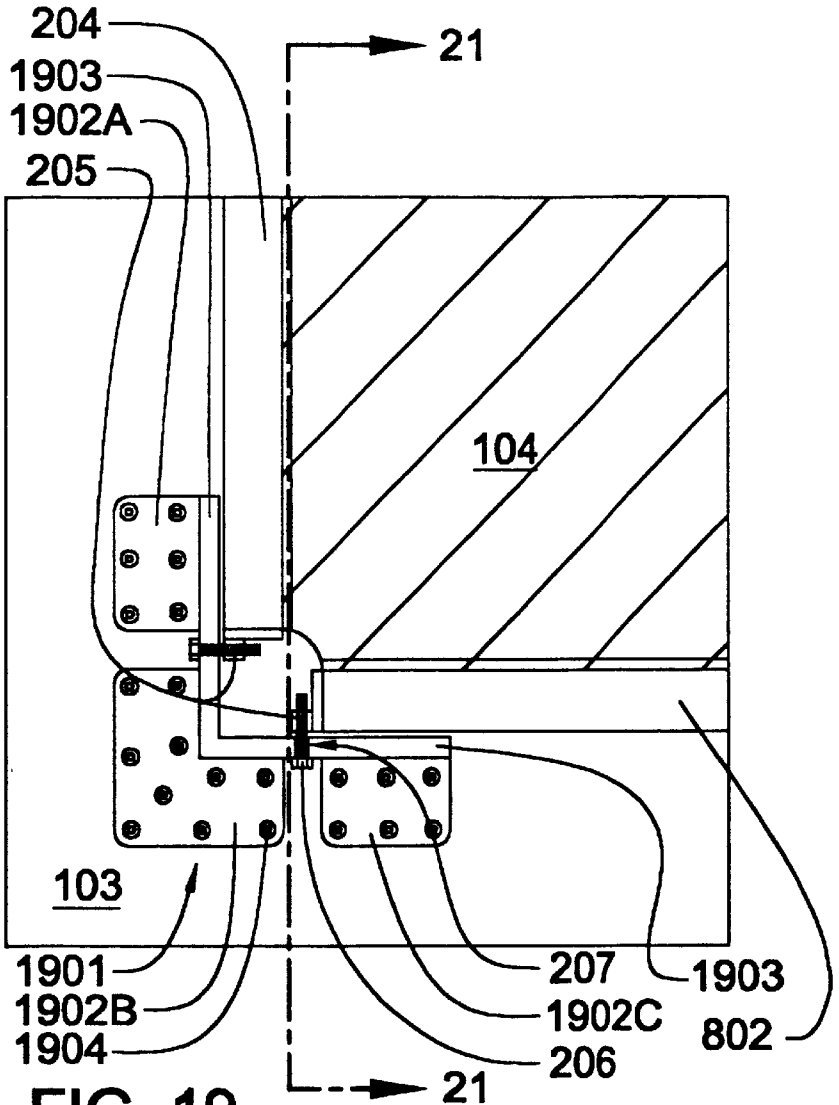
FIG. 19 is a close-up side-elevational view of an alternative corner anchoring bracket for the first and second embodiments of the invention.
Figure 22:
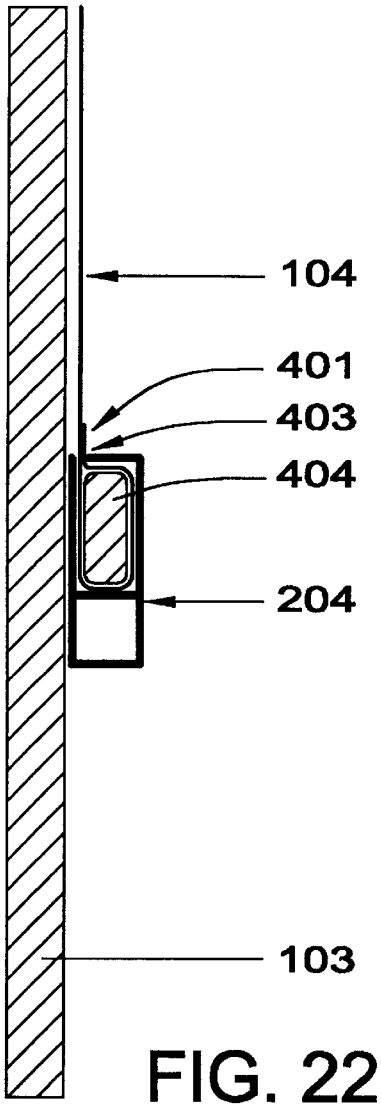
FIG. 22 is a cross-sectional view through line 22—22 of FIG. 19.
Figure 21:
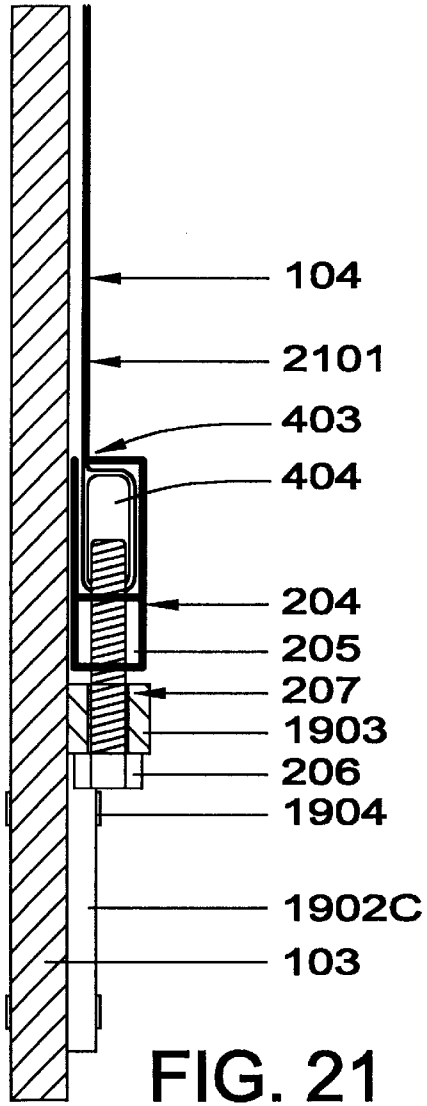
FIG. 21 is a cross-sectional view through line 21—21 of FIG. 18.

Most semi-trailers in use today are as wide as current federal regulations permit. The present regulations permit a maximum with of 2.59 meters (102 inches). Thus, it is imperative that the thickness of the new information display system be kept to an absolute minimum. FIGS. 19–22 depict alternate versions for a low-profile corner anchoring bracket and a low-profile partial-span anchoring bracket for the first embodiment of the invention. The anchoring brackets for the second and third embodiments of the invention may be similarly modified to decrease the thickness. Referring now to FIG. 19, the corner anchoring bracket 1901 is attached the sidewall 103 of the semi-trailer 101 outside the area of the sign sheet 104. The laminar portions 1902A, 1902B, and 1902C are continuous with the tension flanges 1903, and are attached to the sidewall 103 with rivets 1904 or screws (not shown). Three laminar portions are used so that gaps 1905 exist where the bolts are inserted through holes in the tension flanges 2102. This allows the tensioning bolts 1901 to be positioned closer to the sidewall 103, as seen in FIG. 21. In all other respects, the display system is identical to that of the first embodiment system of FIG. 1. A similar arrangement is employed with the partial-span anchoring bracket of FIG. 20, and the low-profile nature of this is shown in FIGS. 21 and 22. The sign sheet 104 is almost in contact with the trailer sidewall 103. The sign sheet 104 appears to be double thickness in FIG. 21, because the cross-section is taken through the sewn or heat-sealed seam 2101 of the sign sheet 104 that forms the perimetric sleeve.

Figure 24:
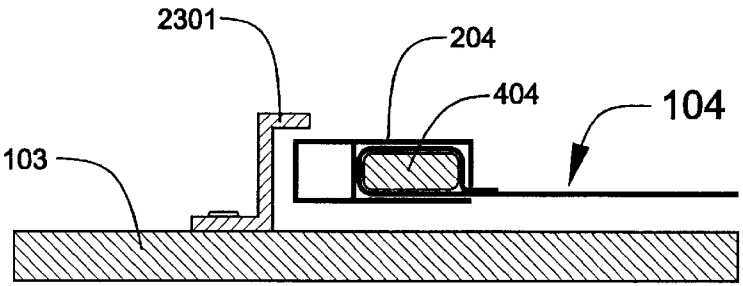
FIG. 24 is a cross-sectional view through line 24—24 of FIG. 23.
Figure 23:
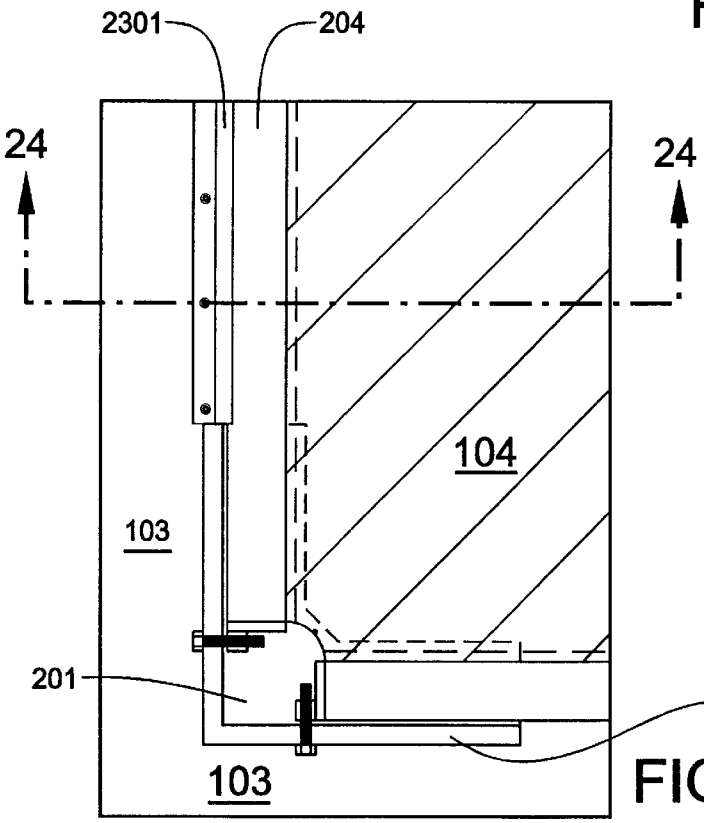
FIG. 23 is a close-up side-elevational view of a first embodiment of the invention in combination with a gap seal.
Figure 20:
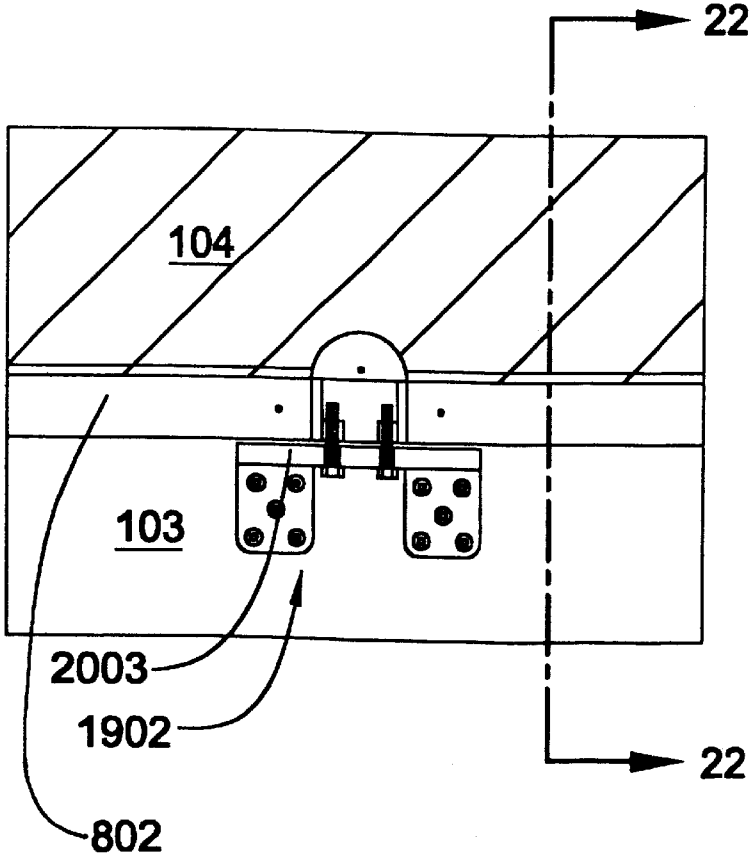
FIG. 20 is a close-up side-elevational view of an alternative partial-span anchoring bracket for the first and second embodiments of the invention.

For any of the three embodiments of the invention, a gap seal may be employed to block airflow beneath the polymeric sheet, which might otherwise cause billowing, flapping, and eventual tearing of the polymeric sheet. FIG. 23 depicts the installation of a gap seal 2301 in combination with the first embodiment information display system of FIG. 1. FIG. 24 depicts the gap seal 2301 in a cross-sectional view. For advertising display mounting on buildings, wind direction may vary from time to time. For such an application, a gap seal surround the entire display has an advantage of preventing airflow beneath the sheet from all directions.

The various components for the three embodiments of the information display system may be fabricated from a variety of materials. Although certain recommendations will now be provided, these recommendations are only suggestions, and are in no way meant to limit the scope of the invention. For preferred embodiments of the invention, suggested materials for the corner and partial-span anchoring brackets are structural metals such as steel, aluminum, magnesium, titanium, or an alloy of those metals. Although light, strong tension beams or tension struts may be readily fabricated from extruded aluminum beams, they may also be fabricated from other metals or from composite materials such as fiberglass-reinforced plastic or carbon fiber-reinforced plastic. It is suggested that the trapping sticks or tubes be fabricated from metal, wood, or composite materials. For the third embodiment of the invention, it is suggested that pulleys be fabricated from a corrosion-resistant metal alloy such as stainless steel.

Although only several embodiments of the new advertising display system are described herein, it will be obvious to those having ordinary skill in the art that changes and modifications may be made thereto without departing from the scope and the spirit of the invention as hereinafter claimed. For example, although a rectangular sign is the most likely shape for most applications, the display system need not be rectangular in, shape. The same principles may be applied to a system having any polygonal shape. A corner anchoring bracket is used at each of the apices of the polygon, while partial-span anchoring brackets may be employed between apices.

What is claimed is:

1. In combination with a wall having a substantially vertical and planar surface, an information display system for mounting on said surface, said system comprising:

a flexible polygonal sheet on which information may be printed, said sheet having a perimetric sleeve formed by a hem around its perimeter;

a plurality of tension struts, each tension strut passing through a portion of said sleeve along at least a portion of a side of said flexible sheet, each tension strut having a threaded member at each end thereof;

a threaded bolt associated with each threaded member; and a plurality of anchoring brackets rigidly attached to said surface, each bracket providing an anchor against which the threaded member at an end of each tension strut is tensionably securable with its associated bolt, said struts, bolts, and brackets forming a reversibly-expandable frame on which the sheet is stretchably mounted.

2. The information display system of claim 1, wherein said surface is the side of a semi trailer.

3. The information display system of claim 1, wherein said surface is the side of a building.

4. The information display system of claim 1, wherein the apices of said sheet have been removed to expose the sleeve at the corners thereof.

5. The information display system of claim 1, wherein each anchoring bracket is anchored to said planar surface outside the periphery of said sign sheet such that said sign sheet does not overly any portion of said anchoring bracket.

6. The information display system of claim 1, which further comprises at least one partial-span anchoring bracket rigidly attached to said planar surface at a location between a pair of corner anchoring brackets, said cable being tensionably secured to said partial-span anchoring bracket.

7. The information display system of claim 1, wherein said sheet is formed from flexible polymeric material.

8. The information display system of claim 7, wherein said sheet is fiber reinforced.

9. The information display system of claim 1, wherein said sheet is formed from tightly-woven, naturally-occuring fibers.

10. The information display system of claim 1, wherein said sheet is formed from tightly-woven, synthetic polymeric fibers.

11. In combination with a wall having a substantially vertical and planar surface, an information display system for mounting on said surface, said system comprising:

a substantially rectangular flexible sheet on which information may be printed, said sheet having a perimetric sleeve formed by a hem around its perimetric edges;

a plurality of tension struts, each tension strut, each tension strut passing through a portion of said sleeve along an edge of said flexible sheet, each tension strut having a threaded member at each end thereof; and a threaded bolt associated with each threaded member; and a plurality of anchoring brackets rigidly attached to said surface in a rectangular pattern, each bracket providing an anchor against which the threaded member at each end of each tension strut is tensionably secured with its associated bolt.

12. The information display system of claim 11, wherein each anchoring bracket is anchored to said planar surface outside the periphery of said sign sheet such that said sign sheet does not overly any portion of said anchoring bracket.

13. The information display system of claim 11, which further comprises at least one partial-span anchoring bracket rigidly attached to said planar surface at a location between a pair of corner anchoring brackets, said cable being tensionably secured to said partial-span anchoring bracket.

14. The information display system of claim 11, wherein said sheet is formed from flexible polymeric material.

15. The information display system of claim 14, wherein said sheet is fiber reinforced.

16. The information display system of claim 11, wherein said sheet is formed from tightly-woven, naturally-occuring fibers.

17. The information display system of claim 11, wherein said sheet is formed from tightly-woven, synthetic polymeric fibers.

* * * * *